US008574102B1

(12) United States Patent
Russell

(10) Patent No.: US 8,574,102 B1
(45) Date of Patent: Nov. 5, 2013

(54) SWING-PITCH SYSTEM

(71) Applicant: Jon A. Russell, Clearwater, FL (US)

(72) Inventor: Jon A. Russell, Clearwater, FL (US)

( * ) Notice: Subject to any disclaimer, the term of this patent is extended or adjusted under 35 U.S.C. 154(b) by 0 days.

(21) Appl. No.: 13/763,990

(22) Filed: Feb. 11, 2013

Related U.S. Application Data

(63) Continuation of application No. 13/486,300, filed on Jun. 1, 2012, now abandoned.

(51) Int. Cl.
*A63B 69/00* (2006.01)

(52) U.S. Cl.
USPC ..... 473/425

(58) Field of Classification Search
USPC ..... 473/425, 507, 475, 429, 424, 416, 147, 473/146; 446/490, 236; 384/622; 273/335, 273/317.8; 119/789, 787.781, 780, 782, 119/708, 707
See application file for complete search history.

(56) References Cited

U.S. PATENT DOCUMENTS

| | | | | | |
|---|---|---|---|---|---|
| 667,563 | A * | 2/1901 | Oakley | 473/424 |
| 2,307,905 | A * | 1/1943 | Ament | 119/708 |
| 3,081,575 | A * | 3/1963 | Meisner | 43/43.12 |
| 3,189,004 | A * | 6/1965 | Sinclair | 119/789 |
| 3,531,115 | A * | 9/1970 | Alexander | 473/424 |
| 3,637,209 | A * | 1/1972 | Raut | 473/424 |
| 3,731,925 | A * | 5/1973 | Caldwell | 473/424 |
| 4,014,553 | A * | 3/1977 | Sakamoto | 473/147 |
| 4,671,314 | A * | 6/1987 | Heil | 137/340 |
| 4,932,660 | A * | 6/1990 | Wang | 473/143 |
| 5,433,435 | A * | 7/1995 | Bourie | 473/424 |
| 6,837,808 | B1 * | 1/2005 | Hatch | 473/424 |
| 6,884,187 | B2 * | 4/2005 | Cataldi et al. | 473/451 |
| 7,798,440 | B2 * | 9/2010 | Crofoot | 242/322 |
| 2006/0014597 | A1 * | 1/2006 | Cantu et al. | 473/422 |

OTHER PUBLICATIONS

Webpage download, gopitbull,2009,www.gopitbull.com/do-yourself/17210-my-first-leash-flirt-pole.htm, 2 pages.*
Runke product information sheet,2010, 1 page.*

* cited by examiner

*Primary Examiner* — Alvin Hunter
*Assistant Examiner* — M Chambers

(57) ABSTRACT

A wand is formed in a hollow cylindrical configuration. The wand has inner and outer ends. A ball has a cylindrical passageway extending diametrically through the ball. An essentially inextensible cord couples the wand and the ball. In this manner a pitcher is adapted to grasp and spin the wand to pitch the ball in a circular manner. Also in this manner a batter is adapted to swing a bat in an attempt to strike the pitched ball for batting practice.

2 Claims, 4 Drawing Sheets

FIG. 1
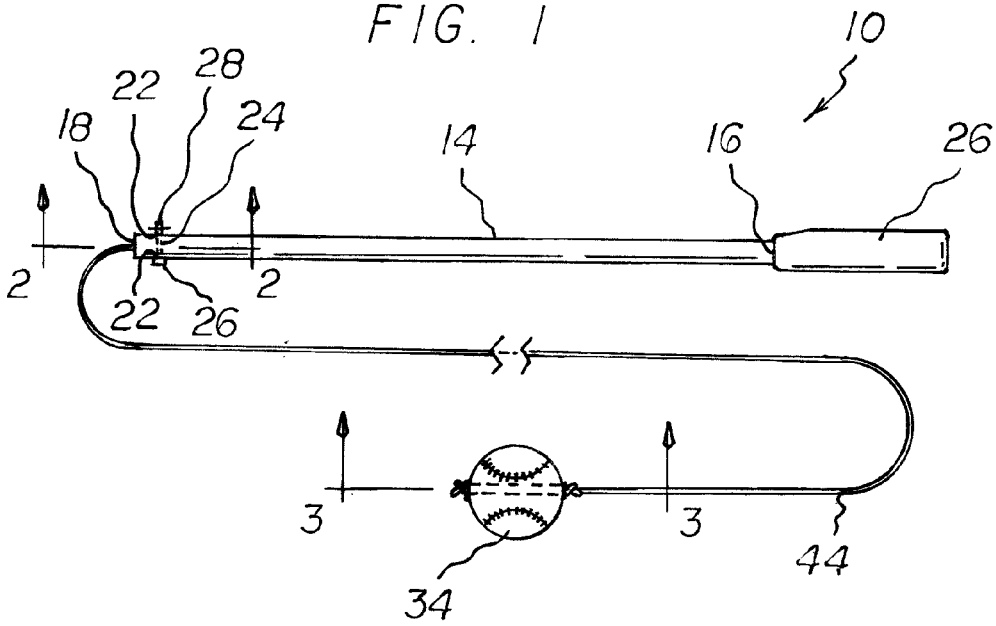
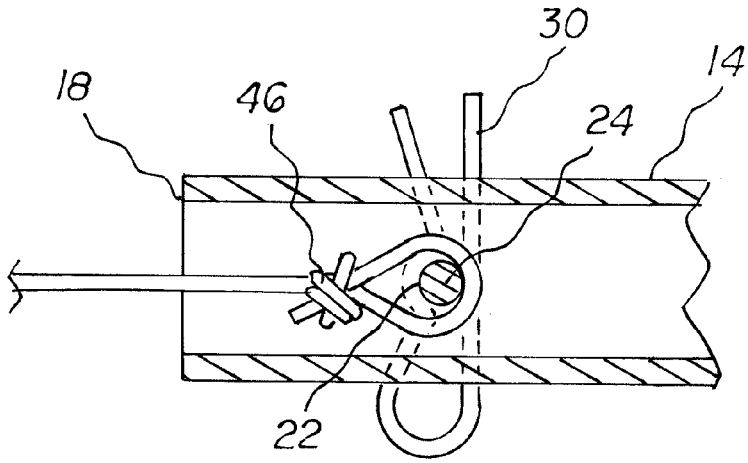
FIG. 2

FIG. 3
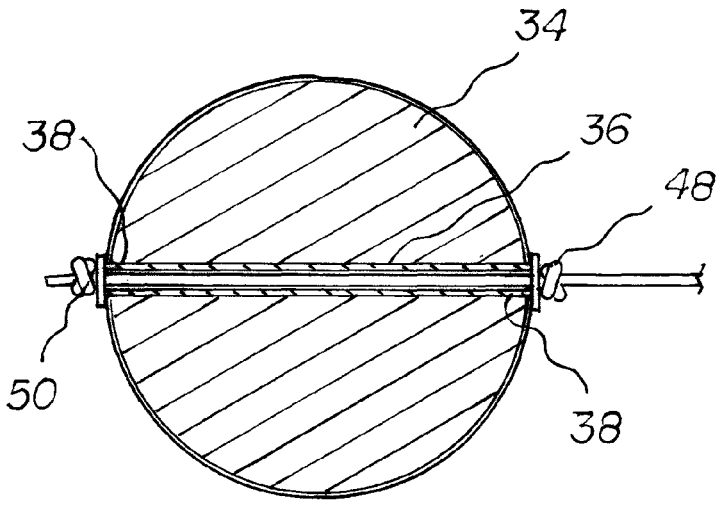
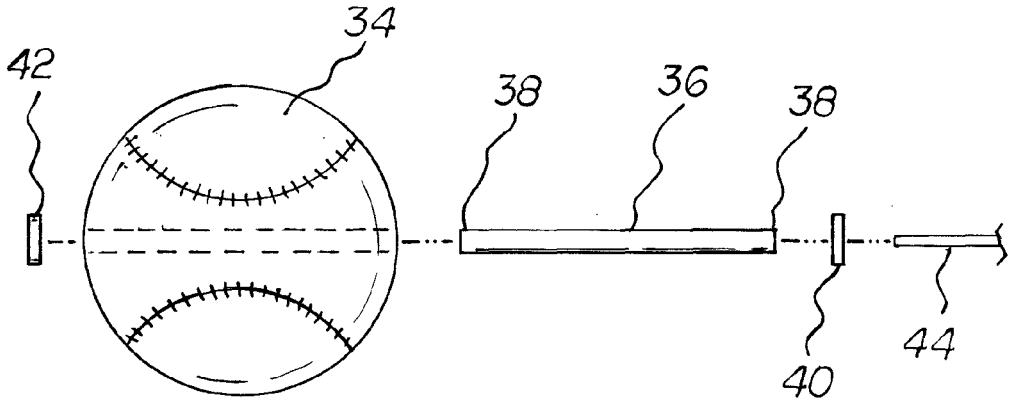
FIG. 4

FIG. 5
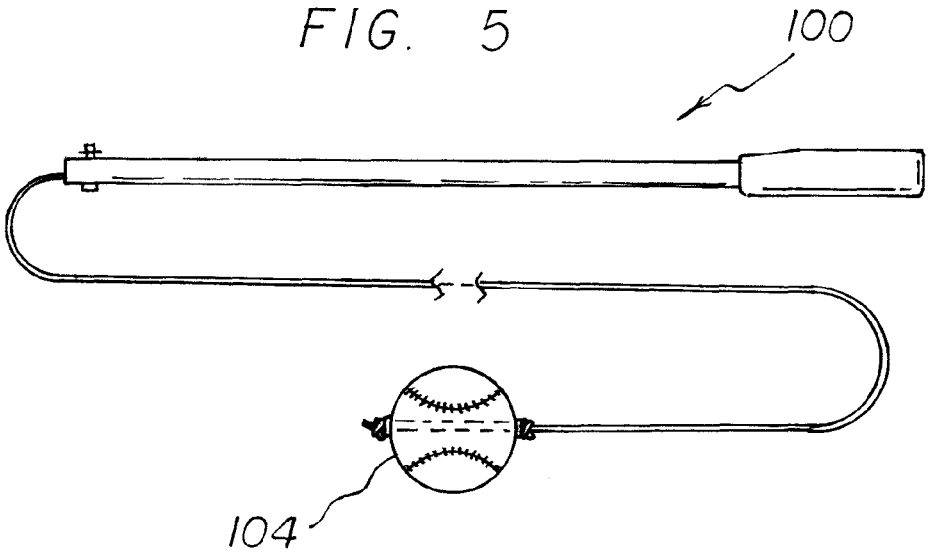
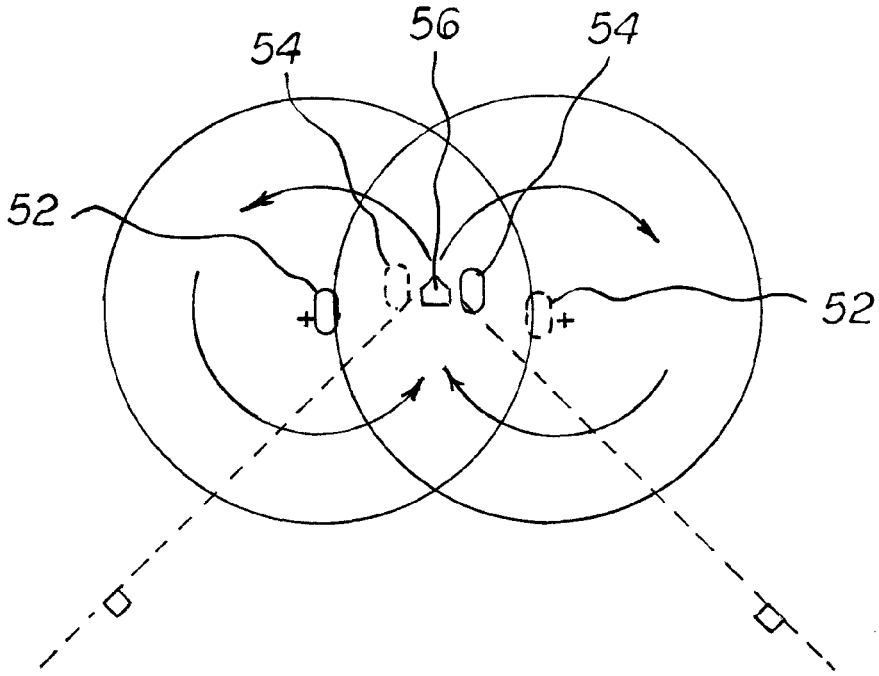
FIG. 6

FIG. 7
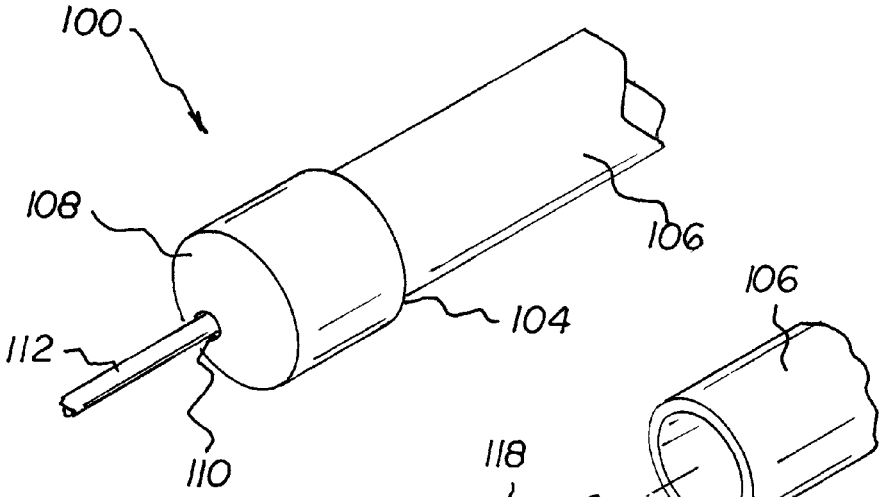
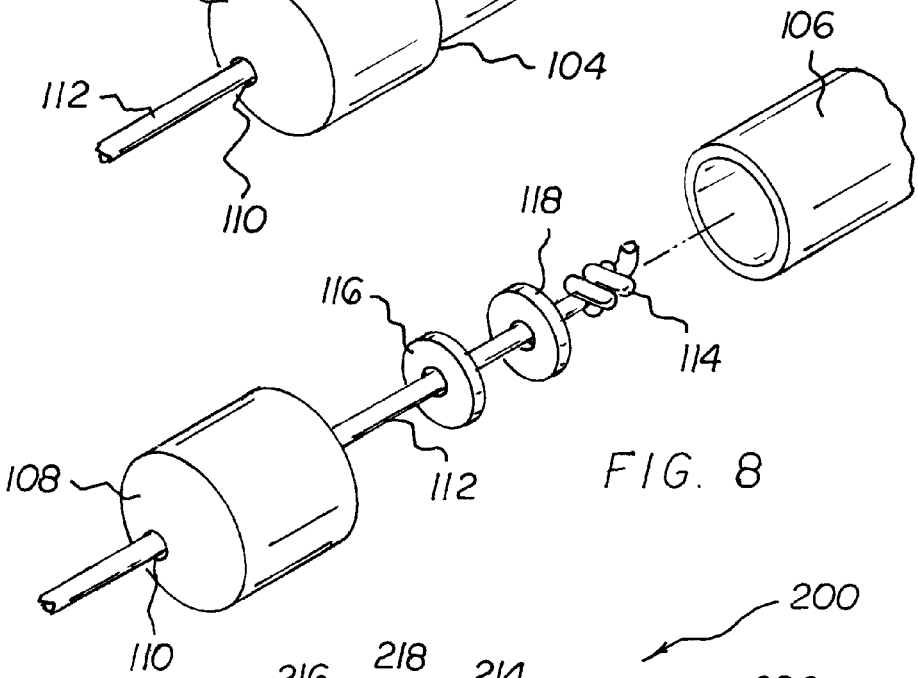
FIG. 8
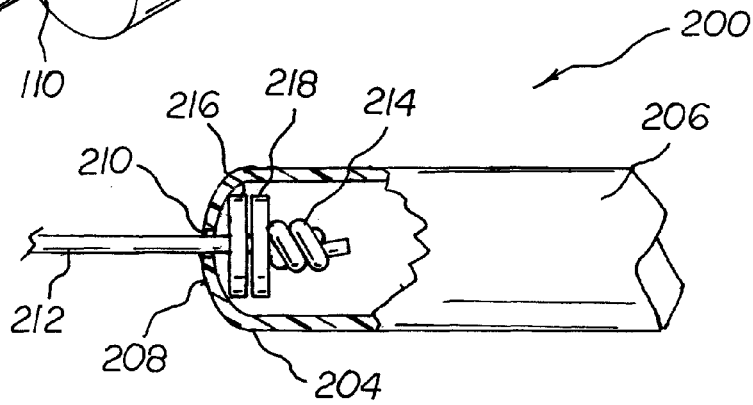
FIG. 9

SWING-PITCH SYSTEM

RELATED APPLICATION

The present application is a continuation-in-part of pending U.S. patent application Ser. No. 13/486,300 filed Jun. 1, 2012, the subject matter of which is incorporated herein by reference.

BACKGROUND OF THE INVENTION

Field of the Invention

The present invention relates to a swing-pitch system and more particularly pertains to supporting a ball on a tethered wand, for spinning the ball by moving the wand and for providing batting practice to participants in proximity, the supporting and spinning and providing being done in a safe, convenient and economical manner.

SUMMARY OF THE INVENTION

In view of the disadvantages inherent in the known types of pitching systems of known designs and configurations now present in the prior art, the present invention provides an improved swing-pitch system. As such, the general purpose of the present invention, which will be described subsequently in greater detail, is to provide a new and improved swing-pitch system and method which has all the advantages of the prior art and none of the disadvantages.

To attain this, the present invention essentially comprises a swing-pitch system. A wand is formed in a hollow cylindrical configuration. The wand has inner and outer ends. A ball has a cylindrical passageway extending diametrically through the ball. An essentially inextensible cord couples the wand and the ball. In this manner a pitcher is adapted to grasp and spin the wand to pitch the ball in a circular manner. Also in this manner a batter is adapted to swing a bat in an attempt to strike the pitched ball for batting practice.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved swing-pitch system which has all of the advantages of the prior art pitching systems of known designs and configurations and none of the disadvantages.

It is another object of the present invention to provide a new and improved swing-pitch system which may be easily and efficiently manufactured and marketed.

It is further object of the present invention to provide a new and improved swing-pitch system which is of durable and reliable constructions.

An even further object of the present invention is to provide a new and improved swing-pitch system which is susceptible of a low cost of manufacture with regard to both materials and labor, and which accordingly is then susceptible of low prices of sale to the consuming public, thereby making such swing-pitch system economically available to the buying public.

Even still another object of the present invention is to provide a swing-pitch system for supporting a ball on a tethered wand, for spinning the ball by moving the wand and for providing batting practice to participants in proximity, the supporting and spinning and providing being done in a safe, convenient and economical manner.

Lastly, it is an object of the present invention to provide a new and improved swing-pitch system. A wand is formed in a hollow cylindrical configuration. The wand has inner and outer ends. A ball has a cylindrical passageway extending diametrically through the ball. An essentially inextensible cord couples the wand and the ball. In this manner a pitcher is adapted to grasp and spin the wand to pitch the ball in a circular manner. Also in this manner a batter is adapted to swing a bat in an attempt to strike the pitched ball for batting practice.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiment and alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a swing-pitch system constructed in accordance with the principles of the present invention.

FIGS. 2 and 3 are enlarged cross sectional views taken along lines 2-2 and 3-3 of FIG. 1.

FIG. 4 is an enlarged cross sectional view of the ball and associated components.

FIG. 5 is a front elevational view of a swing-pitch system constructed in accordance with an alternate embodiment of the invention wherein the baseball of the prior embodiment is replaced with a larger softball.

FIG. 6 is a schematic representation of a pitcher and a batter practicing with the system of the present invention.

FIG. 7 is a perspective illustration of another alternate embodiment of the invention.

FIG. 8 is an exploded perspective illustration of the FIG. 7 embodiment.

FIG. 9 is a side elevational view, partly in cross section of a final alternate embodiment of the invention.

The same reference numerals refer to the same parts throughout the various Figures.

DESCRIPTION OF THE VARIOUS EMBODIMENTS

With reference now to the drawings, and in particular to FIG. 1 thereof, one of the new and improved swing-pitch systems embodying the principles and concepts of the present invention and generally designated by the reference numeral 10 will be described.

The present invention, the swing-pitch system 10 is comprised of a plurality of components. Such components in their broadest context include a wand, a ball, and a cord. Such components are individually configured and correlated with respect to each other so as to attain the desired objective.

First provided is a wand 14. The wand is in a hollow cylindrical configuration. The wand has an inner end 16. The wand has an outer end 18. The wand has an elastomeric bicycle handlebar grip 20. The grip is provided on the inner end of the wand. The grip is adapted to be grasped and held by a user. The wand has diametrically aligned small holes 22. The small holes are provided in the wand adjacent to the outer end. A clevis pin 24 is provided. The clevis pin extends through the small holes. The clevis pin has a central extent. The central extend of the clevis pin is provided within the wand. The clevis pin has a head end 26. The head end of the clevis pin is provided exterior of the wand. The clevis pin has a free end 28. The free end of the clevis pin is provided exterior of the wand. A hitch pin clip 30 is provided. The hitch pin clip is removably positioned on the free end of the clevis pin. In this manner the clevis pin is removably secured in the small holes. The wand has a diameter of 0.5 inches. The wand has a length of 24 inches. The wand is fabricated of a rigid schedule 40 polyvinyl chloride.

Further provided is a ball 34. The ball is chosen from the class of balls. The class of ball includes softballs and baseballs and tennis balls. The ball has a cylindrical passageway. The passageway extends diametrically through the ball. A cylindrical poly tubing sleeve 36 is provided. The cylindrical sleeve is located within the cylindrical passageway. The cylindrical sleeve has opposed ends 38. An interior washer 40 is provided. An exterior washer 42 is provided. The washers are located exterior of the ball adjacent to the opposed ends of the cylindrical sleeve. The cylindrical sleeve and the washers are fabricated of rigid materials.

Provided last is a cord 44. The cord couples the wand and the ball. The cord has a wand end. The wand end of the cord has a bowline on-a-bight first knot 46. In this manner a loop is created. The clevis pin extends through the loop within the wand. In this manner removable securement is facilitated. The cord has a ball end. The ball end of the cord has a FIG. 8 second knot 48. The second knot is provided exterior of the ball and the cylindrical sleeve. The second knot is provided in contact with the interior washer. The ball end of the cord has a FIG. 8 third knot 50. The third knot is provided exterior of the ball and the cylindrical sleeve. The third knot is provided in contact with the exterior washer. The second and third knots span the ball and the cylindrical sleeve and the washers. In this manner the ball is secured at a fixed distance from the wand.

FIG. 5 is a front elevational view of a swing-pitch system 100 constructed in accordance with an alternate embodiment of the invention. In such alternate embodiment, the smaller baseball 34 of the prior embodiment is replaced with a larger soft ball 104. Any number of balls could be substituted including a hollow tennis ball.

In use, a pitcher 52 is provided. A batter 54 is provided. The cord is fabricated of an essentially inextensible 0.15625 inches, number 550 nylon parachute cord material. The cord has a length of between 8 and 12 feet. In this manner the pitcher is adapted to grasp the handle of the wand and spin the wand. Also in this manner the ball is pitched in a circular manner. Further in this manner the batter, whether right handed shown in solid lines or left handed shown in dashed lines, at a plate 56 is adapted to swing a bat in an attempt to strike the pitched ball for batting practice.

An alternate embodiment of the invention, system 100, is shown in FIGS. 7 and 8. In such embodiment, the wand 104 includes a major portion 106 and a separable, generally semi-hemispherical exterior portion 108. The exterior portion has a central aperture 110. The cord 112 extends through the central aperture with a retention knot 114 located within the wand.

The system further includes a bearing assembly bearing assembly formed of a first stainless steel washer 116 and a second stainless steel washer 118. The first and second washers are similarly configured with aligned apertures. The cord extending through the apertures with the second washer being in contact with the knot and the first washer being in contact with the exterior portion of the housing. The first and second washers are in contact with each other whereby rotation of the wand will cause a rotational movement of the second washer with respect to the first washer.

A final alternate embodiment of the invention, system 200, is shown in FIG. 9. In such embodiment, the wand 204 includes a major portion 206 and an integrally formed, generally semi-hemispherical exterior portion 208. The exterior portion has a central aperture 210. The cord 212 extends through the central aperture with a retention knot 214 within the wand.

The system further includes a bearing assembly formed of a first stainless steel washer 216 and a second stainless steel washer 218. The first and second washers are similarly configured with aligned apertures. The cord extending through the apertures with the second washer being in contact with the knot and the first washer being in contact with the exterior portion of the housing. The first and second washers are in contact with each other whereby rotation of the wand will cause a rotational movement of the second washer with respect to the first washer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A swing-pitch system (10) for supporting a ball on a tethered wand, for spinning the ball by moving the wand and for providing batting practice to participants in proximity, the supporting and spinning and providing being done in a safe, convenient and economical manner, the system comprising, in combination:

a wand (14) formed in a hollow cylindrical configuration, the wand having an inner end (16) and an outer end (18), an elastomeric bicycle handlebar grip (20) on the inner end adapted to be grasped an held by a user, the wand having a diameter of 0.5 inches and a length of 24 inches, the wand being fabricated of a rigid schedule 40 polyvinyl chloride; a ball (34) chosen from the class of balls including softballs and baseballs the ball having a cylindrical passageway extending diametrically through the ball, a cylindrical poly tubing sleeve (36) located within the cylindrical passageway, the cylindrical sleeve having opposed ends (38), an interior washer (40) and an exterior washer (42), the washers located exterior of the ball adjacent to the opposed ends of the cylindrical sleeve, the cylindrical sleeve and the washers being fabricated of rigid materials; a cord (44) coupling the wand and the ball, the cord having a wand end formed with a first enlargement (46), the cord having a ball end formed with an enlargement (48) exterior of the ball and the cylindrical sleeve in contact with the interior washer, the ball end of the cord formed an enlargement (50) exterior of the ball and the cylindrical sleeve in contact with the exterior washer, the second and third-enlargements spanning the ball and the cylindrical sleeve and the washers to secure the ball at a fixed distance from the wand, the cord being fabricated of an essentially inextensible 0.15625 inches, number 550 nylon parachute cord material with a length of between 8 and 12 feet whereby a pitcher (52) is adapted to grasp the handle of the wand and spin the wand to pitch the ball in a circular manner and whereby a batter (54) at a plate (56) is adapted to swing a bat in an attempt to strike the pitched ball for batting practice; and wherein the wand (204) includes a major portion (206) and an integrally fabricated generally hemispherical exterior portion (208), the exterior portion having a central aperture (210), and wherein the cord (212) extends through the central aperture with a retention enlargement (214) located within the wand, the system further including a bearing assembly within the wand formed of a first washer (216) and a second washer (218), the first and second washers being fabricated of stainless steel and similarly configured with aligned apertures, the cord extending through the apertures, the second washer being in contact with the retention enlargement, the first washer being in contact with the exterior portion of the housing, the first and second washers being in contact with each other whereby rotation of the wand will cause a rotational movement of the second washer with respect to the first washer.

2. A swing-pitch system (10) for supporting a ball on a tethered wand, for spinning the ball by moving the wand and for providing batting practice to participants in proximity, the supporting and spinning and providing being done in a safe, convenient and economical manner, the system comprising, in combination:

a wand (14) formed in a hollow cylindrical configuration, the wand having an inner end (16) and an outer end (18), an elastomeric bicycle handlebar grip (20) on the inner end adapted to be grasped an held by a user, the wand having a diameter of 0.5 inches and a length of 24 inches, the wand being fabricated of a rigid schedule 40 polyvinyl chloride; a ball (34) chosen from the class of balls including softballs and baseballs the ball having a cylindrical passageway extending diametrically through the ball, a cylindrical poly tubing sleeve (36) located within the cylindrical passageway, the cylindrical sleeve having opposed ends (38), an interior washer (40) and an exterior washer (42), the washers located exterior of the ball adjacent to the opposed ends of the cylindrical sleeve, the cylindrical sleeve and the washers being fabricated of rigid materials; a cord (44) coupling the wand and the ball, the cord having a wand end formed with a first enlargement (46), the cord having a ball end formed with an enlargement (48) exterior of the ball and the cylindrical sleeve in contact with the interior washer, the ball end of the cord formed an enlargement (50) exterior of the ball and the cylindrical sleeve in contact with the exterior washer, the second and third-enlargements spanning the ball and the cylindrical sleeve and the washers to secure the ball at a fixed distance from the wand, the cord being fabricated of an essentially inextensible plastic coated cable with a length of between 8 and 12 feet whereby a pitcher (52) is adapted to grasp the handle of the wand and spin the wand to pitch the ball in a circular manner and whereby a batter (54) at a plate (56) is adapted to swing a bat in an attempt to strike the pitched ball for batting practice; and wherein the wand (204) includes a major portion (206) and an integrally fabricated generally hemispherical exterior portion (208), the exterior portion having a central aperture (210), and wherein the cord (212) extends through the central aperture with a retention enlargement (214) located within the wand, the system further including a bearing assembly within the wand formed of a first washer (216) and a second washer (218), the first and second washers being fabricated of stainless steel and similarly configured with aligned apertures, the cord extending through the apertures, the second washer being in contact with the retention enlargement, the first washer being in contact with the exterior portion of the housing, the first and second washers being in contact with each other whereby rotation of the wand will cause a rotational movement of the second washer with respect to the first washer.

* * * * *